United States Patent [19]

Fletcher et al.

[11] 4,003,117

[45] Jan. 18, 1977

[54] OVERCAPPING APPARATUS

[75] Inventors: Wade D. Fletcher; Jerry F. Sansbury, both of Hartsville, S.C.

[73] Assignee: Sonoco Products Company, Hartsville, S.C.

[22] Filed: Mar. 9, 1976

[21] Appl. No.: 665,337

[52] U.S. Cl. ..... 29/809; 29/235; 53/314

[51] Int. Cl.[2] ..... B67B 3/22; B65B 7/28; B23P 19/02

[58] Field of Search ..... 53/313, 314, 315, 316, 53/319, 168, 171; 29/235, 208 B, 240, 200 A, 450, 211 R

[56] References Cited

UNITED STATES PATENTS

| | | | |
|---|---|---|---|
| 1,502,869 | 7/1924 | Nemecek et al. | 53/314 |
| 3,523,355 | 8/1970 | Schlapkohl | 53/313 X |
| 3,538,678 | 11/1970 | Lefort | 53/319 |
| 3,771,284 | 11/1973 | Boeckmann et al. | 53/315 X |
| 3,924,384 | 12/1975 | Kinney | 53/314 X |

FOREIGN PATENTS OR APPLICATIONS

| | | | |
|---|---|---|---|
| 684,272 | 12/1952 | United Kingdom | 53/314 |

*Primary Examiner*—Othell M. Simpson
*Assistant Examiner*—Horace M. Culver
*Attorney, Agent, or Firm*—Dennison, Dennison, Meserole & Pollack

[57] ABSTRACT

A pair of laterally spaced pocketed starwheels, mounted on a common shaft for synchronized rotation, receive and cradle composite fiber cans in a manner so as to preclude distortion of the cans upon movement past a capping station wherein the edge of each can engages an aligned flexible lid which is wiped onto the can end as the end is drawn past an inclined plate by continued movement of the can. A shaft mounted backing plate, laterally spaced from the outermost starwheel, stabilizes the can during the lid mounting operation.

3 Claims, 6 Drawing Figures

OVERCAPPING APPARATUS

The present invention is generally concerned with the automatic provision of lids or overcaps on containers, and more particularly relates to apparatus capable of accommodating components incorporating some degree of flexibility, such as composite fiber containers and plastic lids, without disruptive distortion of either the container or the lid.

While container capping or lid applying apparatus is well known as exemplified by U.S. Pat. Nos. 2,357,826; 2,618,426; 2,924,921; 3,332,209; and 3,523,355, and extensively used in the container industry, substantial problems arise when attempting to apply known capping technology to specific situations encountered in actual practice.

In the case of the present invention, the problem involved is the effective automatic capping of open ended containers 14 having a degree of flexibility sufficient to cause a severe "egg shaping" of the container as it is carried through the capping apparatus 17. This is particularly noticeable in the increasingly popular composite fiber cans 18, especially where the ends have not previously been applied; thus making the can body extremely flexible. The problems encountered in trying to apply plastic overcaps to such container bodies not having ends attached resulted in this invention. This egg shaping, in addition to having a disruptive effect on the construction of the can, tends to distort the lids or overcaps, normally themselves of a relatively flexible plastic construction. In one contemplated situation, the overcap, before mounting will contain a foil membrane therein, the effectiveness of which will be greatly diminished if wrinkled by an excess flexing of the plastic overcap.

Such problems are effectively overcome by the apparatus of the present invention wherein specific provision is made so as to cradle and carry the cans or containers through the overcapping operation in a manner which precludes any significant distortion of either the cans or the overcaps while at the same time providing for a positive rapid automatic mounting of the overcap.

Other advantages of the present invention include the provision of a system which is simple and substantially completely trouble free in operation, and a system which is adaptable for use in conjunction with substantially any container and lid feeding apparatus.

Basically, the apparatus of the present invention comprises a pair of duplicate laterally spaced pocketed starwheels, mounted on a common shaft for rotation therewith, for closely receiving and cradling sequentially fed containers for movement thereof past a cap applying station. Each container is engaged at spaced points therealong, generally toward the opposed ends thereof, by the starwheels in a manner so as to provide a firm non-distorting support. As each can is advanced toward the lid to be mounted thereon, the leading edge of the can end engages beneath the flange of the lid causing an upward drawing of the lid from the supply past an inclined seating plate which progressively presses the lid on the can end, the non-distorting handling of the can in turn substantially reducing or eliminating any tendency for the lid itself to distort. A shaft mounted backup plate is provided in association with the starwheel so as to provide a can positioning means insuring a proper orientation thereof relative to the lid as well as a stabilization thereof during the application of the lid.

Additional objects and advantages are considered to reside in the details of construction and operation as more fully hereinafter described and claimed. Reference is had to the accompanying drawings forming a part hereof, wherein like numerals refer to like parts throughout, and in which:

Figure 1:
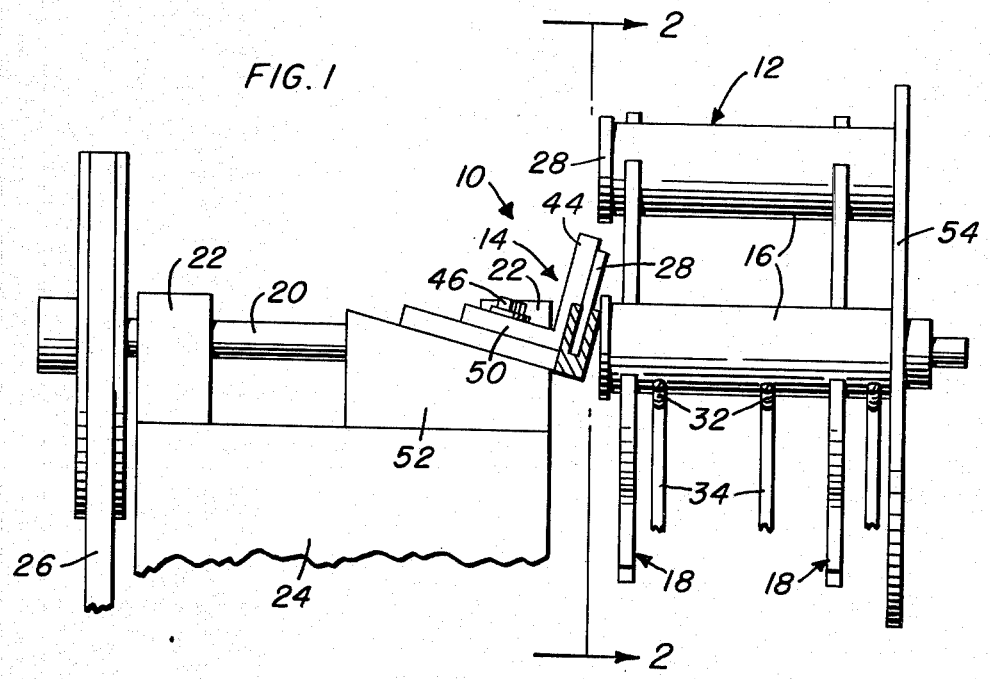
FIG. 1 is a side elevational view of the apparatus of the present invention.

Referring now more specifically to the drawings, reference numeral 10 is used to generally designate the overcapping apparatus comprising the present invention. This apparatus consists basically of two operative assemblies, a container moving assembly 12 and a lid positioning assembly 14.

The apparatus 10 has been specifically devised so as to handle and cap elongated tubular containers or cans 16, normally formed of easily flexed composite fiber construction, without a distortion of the container and without distorting the normally used flexible plastic caps. In furtherance of this goal, the container moving assembly is formed of multiple, normally two, pocketed starwheels 18 which are duplicates of each other and mounted in laterally spaced aligned orientation with each other on a common shaft 20. Both starwheels 18 are fixed to the shaft 20 for rotation therewith. The shaft 20 itself can be driven in any appropriate manner. For example, as illustrated, the shaft 20 can be rotatably received through a pair of bearing units 22 fixed to a rigid support 24 with the remote end of the shaft engaged by appropriate belt drive means 26.

The starwheels 18 are so positioned, relative to each other, as to engage each container or can 16 at spaced points along the length thereof with one of the starwheels orientated immediately inward of the end of the container 16 which is to receive the lid or overcap 28 as shall be described presently.

Figure 2:
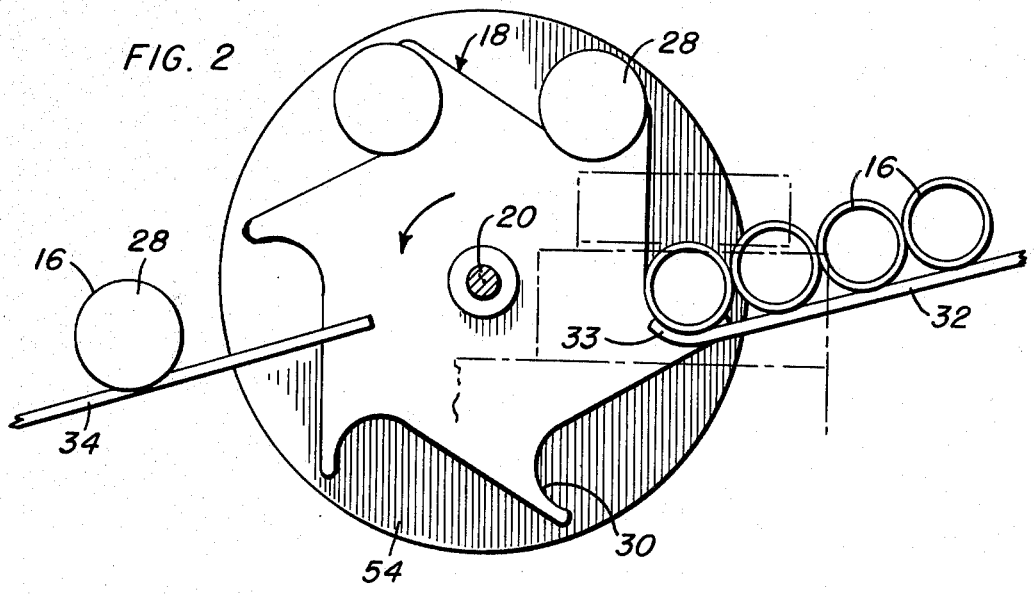
FIG. 2 is an elevational view taken substantially on a plane passing along line 2—2 in FIG. 1.
Figure 6:
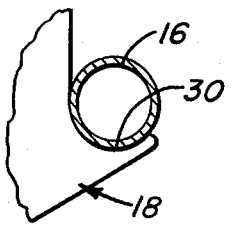
FIG. 6 is a detail view illustrating the manner in which each container is cradled within a starwheel pocket.
Figure 3:
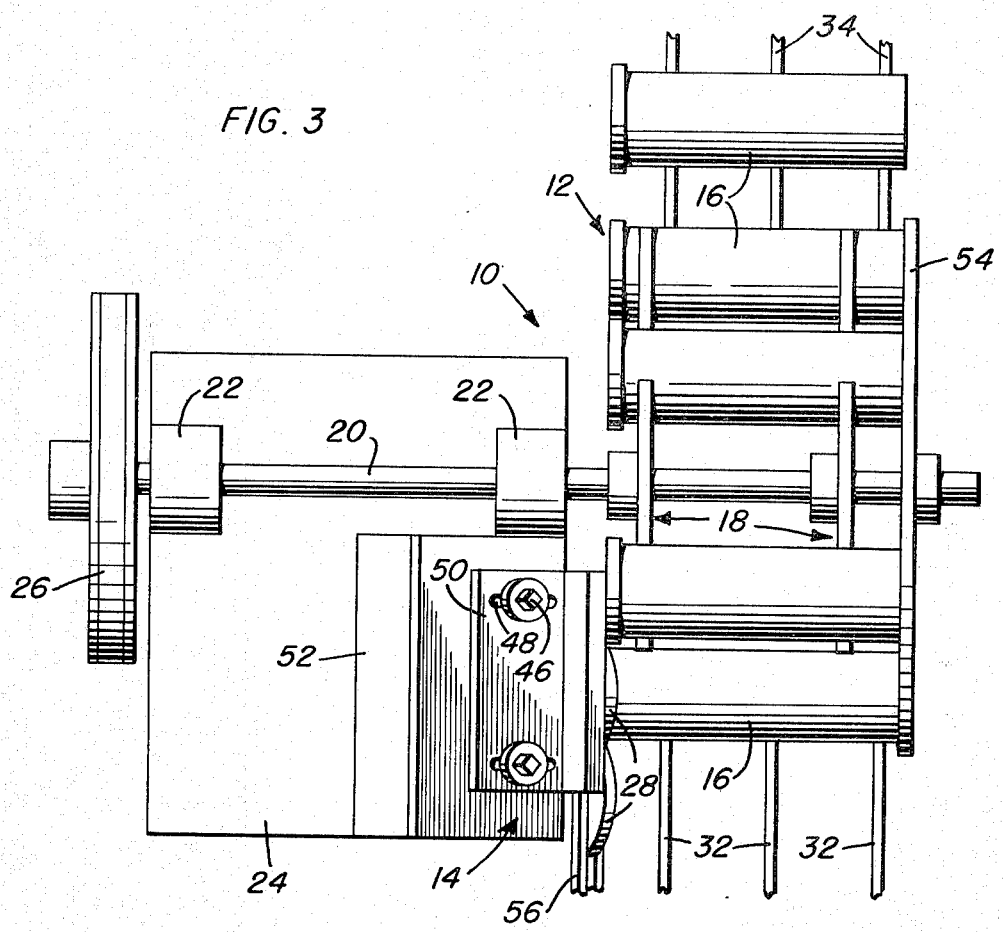
FIG. 3 is a top plan view of the apparatus.
Figure 4:
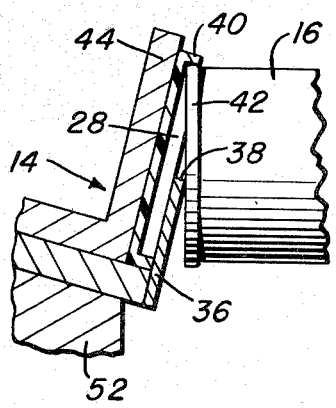
FIG. 4 is a detail view illustrating the initial engagement of a container end with an overcap.
Figure 5:
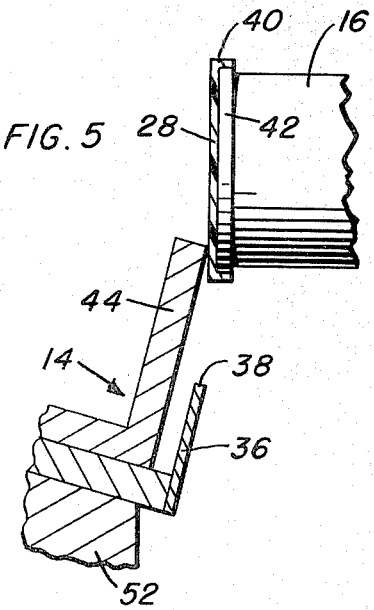
FIG. 5 is a detail view similar to FIG. 4 and illustrating the completion of the overcap mounting.

Noting FIGS. 1 and 3 it will be appreciated that each starwheel 18 is relatively thick so as to provide a wide surface engageable with the container 16. Noting FIGS. 2 and 6, it will be seen that each starwheel 18 is provided with multiple pockets 30 defined about the periphery thereof. Each of the pockets 30 is open forwardly in the direction of rotation of the starwheels 18, as indicated by the arrow in FIG. 2. Each of the pockets 30 is of a size so as to closely conform to the periphery of the received container 16 through slightly less than one half the circumference thereof, thereby significantly contributing to the stability of the container 16 and effectively reducing any tendency for a compression of the container or a flexing thereof into a generally egg shaped configuration as frequently occurs when using known equipment. Incidentally, while the starwheels have been illustrated as incorporating six pockets, it will be appreciated that the number of pockets can vary from one to as many as can be accommodated by the circumference of the starwheel and still effectively receive and move the containers.

The containers 16 can be fed to the starwheels 18 by any appropriate means. For purposes of illustration, a simple gravity chute incorporating spaced inclined rails 32, with curved lower pickup ends 33, has been shown. Noting FIG. 1 in particular, the spacing of the rails 32 is such so as to allow for a movement of the starwheels 18 therebetween so as to engage, seat and raise the lowermost container 16 on the chute. After the overcapping operation, and as will be best appreciated from FIG. 2, the capped containers are discharged, in the illustrated embodiment on an inclined discharge chute consisting of spaced rails 34.

Referring now to the lid positioning assembly 14, the purpose of this assembly is to orientate a lid or cap 28 in the path of the end of a starwheel mounted container 16 for engagement by and seating on the container end automatically as the container is carried in its circular path by the starwheels 18. In the illustrated embodiment, the positioning assembly 14 includes a relatively short front wall 36 angled toward the path taken by a starwheel supported container 16 and terminating, at its upper edge 38, just short of the plane of the container end which is to receive the lid 28. A lid 28 engages against the wall 36 with the orientation and heighth of the wall 36 being such so as to position the lid 28 with the upper flanged edge 40 thereof directly within the path of the beaded container edge 42 for engagement of this beaded edge within the flange 40 in a manner whereby the lid 28 is raised along with the upwardly carried container or can 16. The actual wiping or pressing of the lid 28 on the container end is effected by a second wall 44 parallel to and rearward of the wall 36. The wall 44 is of a heighth slightly greater than that of the lid 28 with the upper forward face of the wall 44 being substantially in the plane of the end of the container 16, or spaced therefrom only an amount equal to the thickness of the planar portion of the lid 28. In this manner, as the lid 28 is drawn upward by engagement of the flange 40 thereof with the beaded end 42 of the container 16, the lid 28 is pressed or wiped onto the container end with substantially no distortion thereof and in a manner so as to snap lock the lid flange 40 to the container edge bead. Noting FIG. 3 in particular, provision can be made for an adjustment of the wall 44 by appropriate means such as bolts 46 engaged through elongated slots 48 defined in a laterally projecting flange or base 50 on the wall 44 which engage within appropriate threaded sockets on the subjacent support 24 or a builtup angled extension 52 thereon which can provide the desired fixed inclination for the walls 36 and 44.

Incidentally, in order to stabilize the cans or containers 16 as the lids 28 are being pressed thereon, an appropriately positioned backup plate or disc 54 is fixed to the shaft outward of the outer starwheel 18 for an engagement of the second end of each container 16 thereagainst, particularly at such time as the lid 28 is being applied. This backup plate 54, being fixed to the shaft 20, will rotate therewith and with the starwheel mounted containers 16.

As will be appreciated, the lids 28 will preferably be fed sequentially to the position wherein they are engaged by the containers 16 sequentially carried therepast by the starwheels 18. This can be accomplished in any appropriate manner, such as an inclined channel 56, as suggested in FIG. 3, which aligns with the space between the walls 36 and 44 and down which the lids 28 slide or roll. An appropriate short stop or abutment will normally be provided so as to properly position the lowermost lid 28 for engagement by a container end.

As will be appreciated from the drawings, in the illustrated embodiment the container engages the corresponding lid as or shortly after it is lifted from the lower end of the feed rails 32 by a pair of aligned pockets 30 within the two starwheels 18. The engaged container and cap are then moved past the relatively taller wall 44 which, through the inward inclination thereof, effectively wipes or presses the cap 28 on the container. The container with the capped end is then downwardly discharged from the starwheel pockets at a point approximately 180° removed from the pickup point. It will of course be appreciated that the feeding of the containers and caps will be synchronized with the rotation of the dual starwheels to achieve a smooth, continuous and relatively high speed operation.

From the foregoing, it is to be appreciated that apparatus has been defined for effecting an automatic overcapping or lid applying operation particularly adapted for the accomodation of containers, such as composite fiber containers, wherein there is an inherent degree of flexibility which must be accommodated both so as to avoid a distortion of the can and so as to avoid a corresponding distortion of the lid as it is applied thereto. In the present apparatus, each container is cradled at spaced points by at least two pocketed starwheels, one of which is positioned closely adjacent the end to receive the lid. Each container receiving pocket closely engages the cylindrical container about just less than one half the circumference thereof. In this manner, an effective lateral restraint is provided about substantially one half the circumference of the container so as to effectively resist any egg shaping or distortion as the container is moved and as the lid is engaged thereby and wiped thereon.

The foregoing is illustrative of the principles of the invention. Since modifications and changes may occur to those skilled in the art, it is not desired to limit the invention to the exact construction and operation shown and described. Accordingly, all suitable modifications and equivalents may be resorted to, falling within the scope of the invention as claimed.

We claim:

1. Overcapping apparatus for the application of flexible lids to the ends of horizontally oriented elongated flexible cylindrical containers, said apparatus comprising container carrying means for horizontally receiving and carrying elongated containers along a vertical arcuate path; container feeding means for introducing containers to said container carrying means; lid positioning means for sequentially generally vertically orienting lids in the path of the ends of moving containers for engagement therewith and thereon; and lid feeding means for introducing lids to said lid positioning means; said container carrying means comprising a pair of spaced vertically oriented wheels with multiple pockets defined about the periphery of each wheel, each pocket having a horizontally aligned companion pocket on the other wheel for simultaneous seating of a horizontal container, means for rotating said wheels simultaneously about a common horizontal axis whereby the pockets on each wheel describe a circular vertical path including an upwardly directed path portion during which containers are engaged within said pockets and raised from the container feeding means, and a downwardly directed path portion during which containers are gravity discharged from said pockets, said pockets opening forwardly in the direction of rotation of said wheels, each pocket being arcuate and of an extent so as to encircle approximately, but no more than, one half the circumference of a cylindrical container to maintain free entry to and free discharge from the pocket by a container while maintaining a high degree of lateral stability to a container received within the pocket, one of said wheels being positioned closely adjacent said lid positioning means for direct support and stabilization of a lid receiving container end closely adjacent said lid positioning means, said lid positioning means being located along the upwardly directed path portion of said pockets, and a vertically orientated backup laterally of and parallel to the wheel remote from said lid positioning means.

2. The apparatus of claim 1, wherein said backup rotates about a common horizontal axis with said wheels.

3. The apparatus of claim 2 wherein said lid positioning means comprises, relative to the adjacent wheel, laterally spaced upstanding near and far walls which receive generally vertically oriented lids therebetween, said near wall being dimensioned for a projection of the lids thereabove, said far wall being taller than said near wall and of a heighth normally greater than the heighth of the lids, said walls inclining inwardly toward the upwardly directed portion of the path of movement of the ends of the moving containers which are to receive the lids, said near wall having an upper edge terminating outward of the container end path for a free movement of the container end thereby and into engagement with an overlying lid edge, said far wall projecting inwardly substantially into the path of the container end for a wiping engagement of the lid thereon as the lid is engaged and moved by the container end carried therepast.

* * * * *